US008056273B2

(12) United States Patent
Goldburt

(10) Patent No.: US 8,056,273 B2
(45) Date of Patent: Nov. 15, 2011

(54) CONTAINER FOR BEVERAGES

(76) Inventor: Tim Goldburt, Ardsley, NY (US)

( * ) Notice: Subject to any disclaimer, the term of this patent is extended or adjusted under 35 U.S.C. 154(b) by 136 days.

(21) Appl. No.: 12/655,444

(22) Filed: Dec. 29, 2009

(65) Prior Publication Data

US 2011/0155604 A1 Jun. 30, 2011

(51) Int. Cl.
*G09F 3/00* (2006.01)

(52) U.S. Cl. ..... 40/310; 40/638; 40/463

(58) Field of Classification Search ..... 40/310, 40/638, 306, 463, 448
See application file for complete search history.

(56) References Cited

U.S. PATENT DOCUMENTS 716,793 A * 12/1902 Vogeler ..... 40/310
823,008 A * 6/1906 Vendig ..... 40/310
1,554,191 A * 9/1925 Alexander ..... 40/310
1,653,608 A * 12/1927 Allen ..... 40/310
1,686,354 A * 10/1928 Wallace ..... 40/310
1,769,147 A * 7/1930 Lennon ..... 40/310
1,856,550 A * 5/1932 Guenard ..... 40/310
5,297,247 A * 3/1994 Kan ..... 340/7.56
7,152,832 B2 * 12/2006 Wochnick ..... 248/74.3
2005/0134461 A1 * 6/2005 Gelbman et al. ..... 340/572.8
2007/0091123 A1 * 4/2007 Akashi ..... 345/629
2011/0122120 A1 * 5/2011 Feuilloley ..... 345/211

OTHER PUBLICATIONS

"Tech-Recipes," http://www.tech-recipes.com/rx/2484/iphone_change_the_auto_lock_delay/, Jun. 29, 2007.*

* cited by examiner

*Primary Examiner* — Gary Hoge
(74) *Attorney, Agent, or Firm* — I Zborovsky

(57) ABSTRACT

A container for beverages has a hollow container body having a recess, and an electronic device attached to the hollow container body and provided with a display for displaying electronic images, and the electronic device is configured so that when inserted into the recess of the container body it is held in the recess.

9 Claims, 3 Drawing Sheets

FIG. 2a
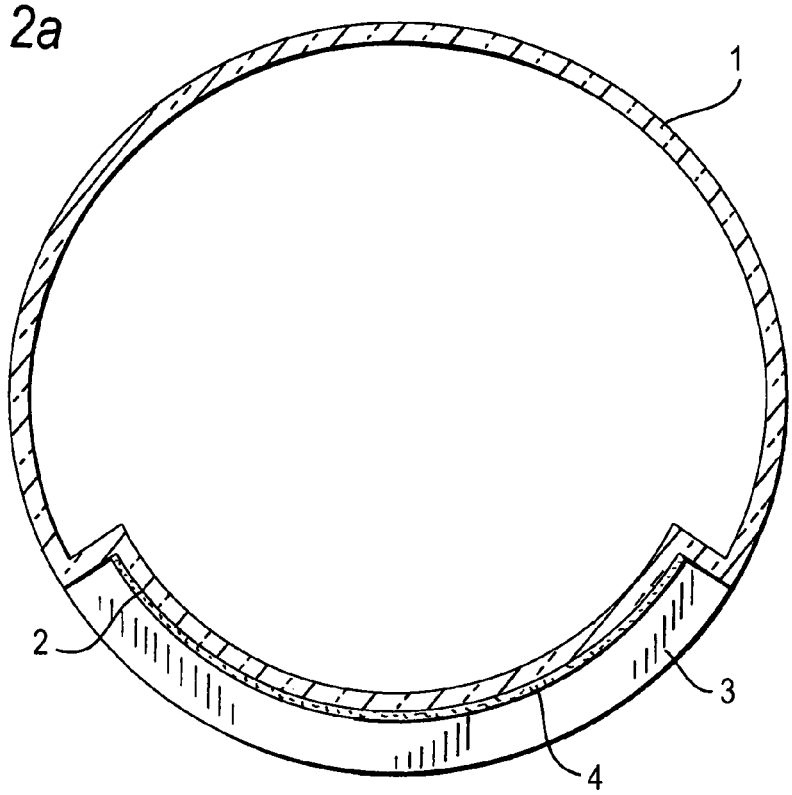
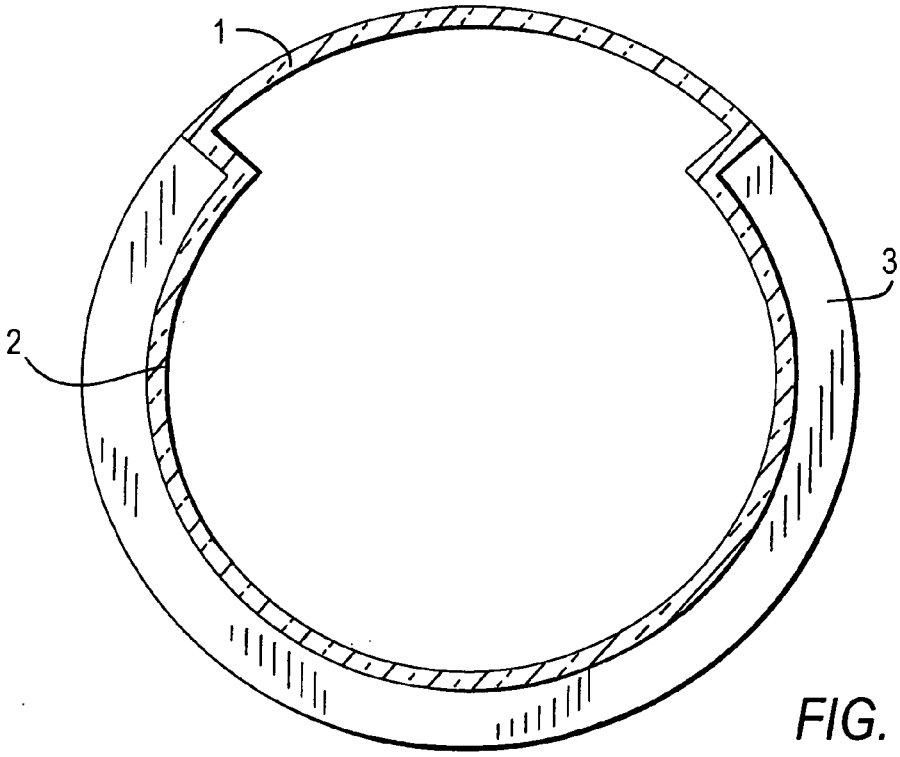
FIG. 2b

CONTAINER FOR BEVERAGES

BACKGROUND OF THE INVENTION

The present invention relates to containers for beverages.

More particularly, it relates to containers for beverages, which are provided with additional devices attached to them.

Some of such containers for beverages are disclosed in our patent application Ser. Nos. 11/588,494; 11/821,334; 11/821,335; 11/828,349; 12/454,862; 12/454,863; 12/590,000 and 12/590,013 which are incorporated here by reference thereto and form a basis for claim to priority.

It is believed that this containers for beverages can be further improved.

SUMMARY OF THE INVENTION

Accordingly, it is an object of the present invention to provide a container for beverages, which is a further improvement of existing containers.

In keeping with these objects and with others which will become apparent hereinafter, one feature of the present invention resides, briefly stated, in a container for beverages, comprising a hollow container body having a recess; and an electronic device attached to said hollow container body and provided with a display for displaying electronic images, said electronic device being configured so that when inserted into said recess of said container body it is held in said recess by embracing a part of said container body.

The electronic device can be held by tightly fitting into a recess of the container body or by tightly embracing a part of the container body in the recess, or by both actions at the same time, etc.

In addition, the container of the invention can be provided with adhesive means for improving holding of said electronic device and said recess of said container body.

In the inventive container said electronic device can have microprocessing means for generating said electronic messages, and control means for controlling operation of said microprocessing means.

The control means can select said messages in an increasing order and in a decreasing order, and can include two control buttons for selecting the messages in the increasing order and the decreasing order.

The control means can be s formed so that when a respective one of said buttons is pressed the images are displayed in the increasing order or in the decreasing order correspondingly, but when a pressure on said buttons is removed the selection of the messages is stopped and the selected messages are displayed on said display. Also, the control means is formed so that said display turns off automatically.

The control means can be formed so that a time of displaying the messages before turning off is adjusted by said control means. They also can be formed so that said display can turn off or can stay operating without turning off.

The container of the present invention can have battery means for battery operated power supply to said microprocessor means and said control means, and it can be provided with a cable pluggable into a source of alternating current, and means for converting alternating current into direct current for power supply to said microprocessor means and said control means.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 2*a* and 2*b* are views showing the cross-section of the container for beverages with the electronic device in accordance with two embodiments of the present invention;

DESCRIPTION OF THE PREFERRED EMBODIMENTS

Figure 1:
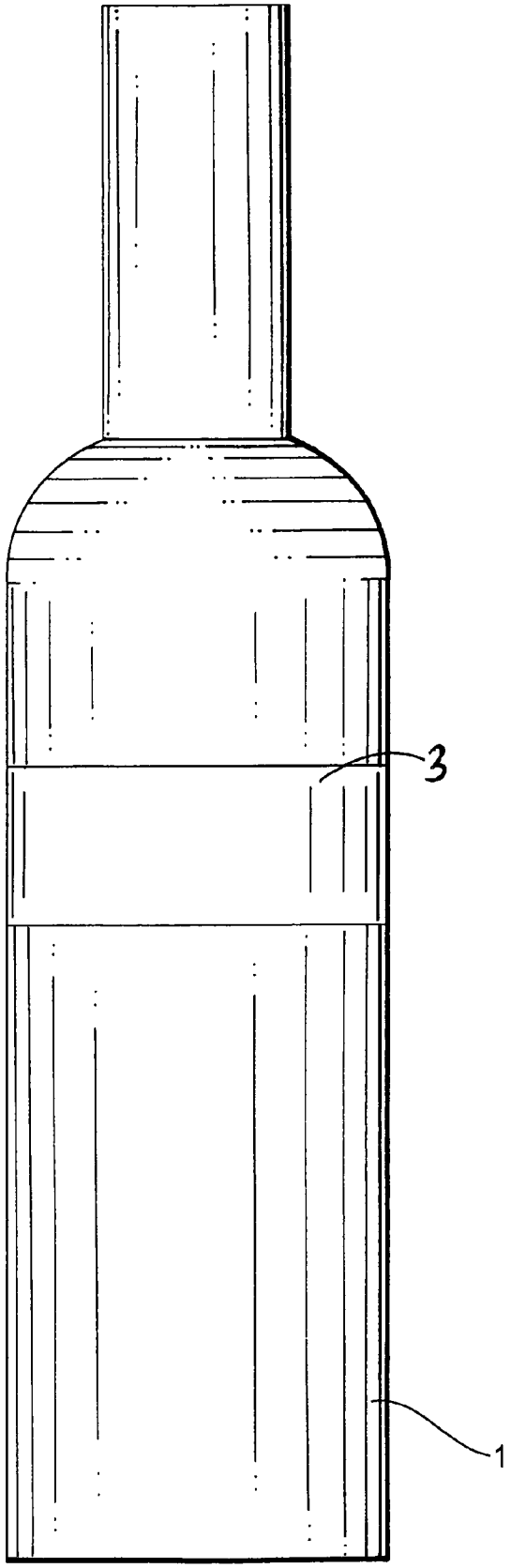
FIG. 1 is a side view showing a container for beverages with an electronic device in accordance with the present invention.
Figure 3:
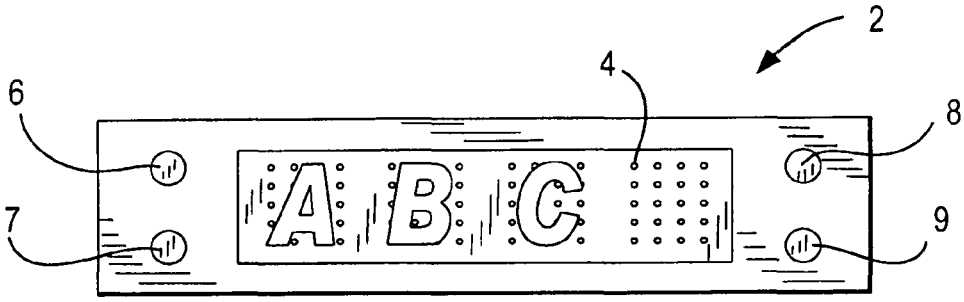
FIG. 3 is an enlarged view of a front surface of the electronic device of the inventive container for beverages.
Figure 4:
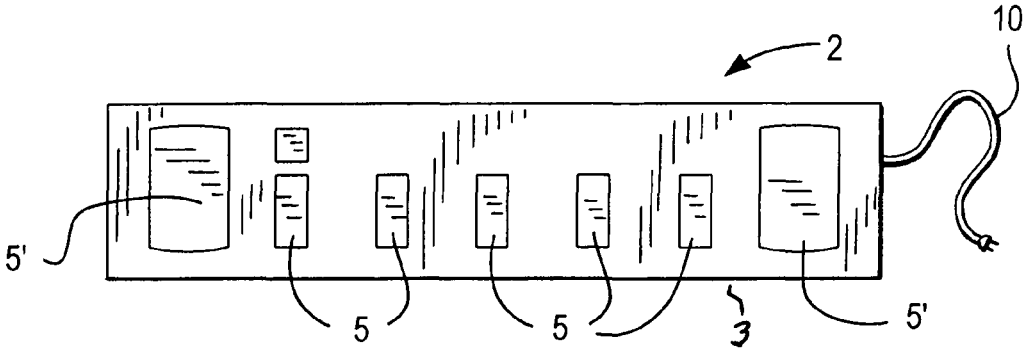
FIG. 4 is a view showing a back side of the electronic device of the inventive container for beverages.

A container for beverages in accordance with the present invention has a hollow container body which is identified with reference numeral 1 and is used for accommodating alcoholic or non-alcoholic beverages.

The container body 1 is provided with a recess identified with reference numeral 2. An electronic device 3 is arranged in the recess 2.

The electronic device 3 is formed so that when inserted in the recess, it is firmly held there. The electronic device 3 can be formed for this purpose with dimensions slightly greater that the dimensions (height, width, depth) of the recess, so that when forcibly inserted into the recess due to yieldability of the material of the device and/or container, the device is reliably held there, as shown in FIG. 2*a*.

Also, the electronic device 3 can be formed as a substantially springy element, which when inserted in the recess 2, is firmly held inside the recess by a spring action of the springy electronic device 3, which surround a part of the container body over more than 180°.

The electronic device 3 can be provided with additional adhesive means formed for example by adhesive layers 4 which are initially covered by a non-adhesive material that later is removed to expose the adhesive means or layers 4, so as to additionally secure the electronic device 3 in the recess 2 on the part of the container body 1.

The whole unit can be completely circumferentially closed, or partially open.

The electronic device can further have a display 4. The display 4 can include a plurality of LEDs or OLEDs, arranged in several rows and columns.

The electronic device 3 further has a microprocessor 5. The microprocessor 5 is designed to provide several functions. It has a memory in which individual elements such as letters, numbers, symbols are stored, and in which preliminarily selected messages can be stored as well. The microprocessor also has means for generating on the display corresponding elements (letters, numerals, symbols, light, running lights, etc.)

The additional element 3 can be connected with said electronic device detachably or non-detachably. The detachable connection can be carried out for example by interengaging projections and holes. The non-detachable connection can be done for example by welding, fusing, etc.

The electronic device further has control means which include an on/off button 6, an entry button 7, an up button 8, and a down button 9.

The electronic device further has control means which include an on/off button 6, an entry button 7, an up button 8, and a down button 9.

In accordance with the present invention, the microprocessing means or microprocessor 5 is designed so that it provides generation on the display 4 of messages including running light messages. The electronic device 3 also has batteries 11.

The electronic device of the electronic container for beverages operates in the following manner.

When the on/off button is pressed by a user, a preliminarily provided message is displayed on the display 4 as a running light message. By pushing the button 8 or the button 9 the other preliminarily provided message can be selected correspondingly in an ascending order or in a descending order.

In accordance with the present invention, a user can compose a new message to be displayed on the display 4. For this purpose the entry button 7 is pressed, and by pressing the button 8 or 9 letters, numbers, or symbols successively appear on the display 4. in order to memorize the corresponding letter, number or symbol, the entry button 7 is pressed again. By repeating this operation a corresponding number of times, a corresponding message can be composed, and then the on/off button is pressed to memorize this message. This light message which is thusly selected by the user is then displayed on the display 4.

The letters to be selected can be letters of any alphabet, the numbers to be selected can be numbers of any calculating system, and the symbols can be any symbols such as a star, a flag, a geometric figure, a face, etc.

The electronic device can be provided with an electrical cable 10 with AC/DC convertor to be plugged in a power source to operate the device.

The control and the microprocessor means is formed so that when a respective one of the buttons 8 or 9 is pressed the images are displayed in the increasing order or in the decreasing order correspondingly, but when a pressure on the buttons is removed the selection of the messages is stopped and the selected messages are displayed on said display.

The control means and the microprocessor can be also formed so that the display turns off automatically.

Furthermore, the control means and the microprocessor can be formed so that a time of displaying the messages before turning off is adjustable by the control means.

Also, the control means can be formed so that said display can turn off or can stay operating without turning off.

It will be understood that each of the elements described above, or two or more together, may also find a useful application in other types of constructions differing from the type described above.

While the invention has been illustrated and described as embodied in a container for beverages, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A container for beverages, comprising a hollow container body having a recess; and an electronic device attached to said hollow container body and provided with a display for displaying electronic images, said electronic device being configured so that when inserted into said recess of said container body it is held in said recess by tightly embracing a part of said container body, wherein said electronic device has a microprocessor for generating said electronic image, and control means for controlling operation of said microprocessor, wherein said control means select said messages in an increasing order and in a decreasing order, wherein said control means include two control buttons for selecting the messages in the increasing order and the decreasing order, wherein said control and said microprocessor are formed so that when a respective one of said button is pressed the images are displayed in the increasing order or in the decreasing order correspondingly, but when a pressure on said buttons is removed the selection of the message is stopped and the selected messages are displayed on said display.

2. A container for beverages as defined in claim 1, wherein said electronic device and said recess have corresponding dimensions selected so that when said electronic device is forcibly inserted in said recess it is tightly held there.

3. A container for beverages as defined in claim 1, wherein said electronic device is substantially springy so that when inserted in said recess, it is held in it by a springy action.

4. A container for beverages as defined in claim 1; and further comprising adhesive for improving holding of said electronic device and said recess of said container body.

5. A container for beverages as defined in claim 1, wherein said control means and said microprocessor are formed so that said display turns off automatically.

6. A container for beverages as defined in claim 1, wherein said control means and said microprocessor are formed so that a time of displaying the messages before turning off is adjusted by said control means.

7. A container as defined in claim 1, wherein said control means and said microprocessor are formed so that said display can turn off or can stay operating without turning off.

8. A container as defined in claim 1; and further comprising battery means for battery operated power supply to said microprocessor and said control.

9. A container as defined in claim 1; and further comprising means for converting A/C current into D/C current, a cable pluggable into a source of alternating current, and means for converting alternating current into direct current for power supply to said microprocessor and said control means.

* * * * *

UNITED STATES PATENT AND TRADEMARK OFFICE

CERTIFICATE OF CORRECTION

PATENT NO. : 8,056,273 B2
APPLICATION NO. : 12/655444
DATED : November 15, 2011
INVENTOR(S) : Tim Goldburt It is certified that error appears in the above-identified patent and that said Letters Patent is hereby corrected as shown below:

Claims

In claim 1, col. 4, line 23, delete “button” and insert --buttons--

Signed and Sealed this
Fifth Day of April, 2016

Michelle K. Lee

Michelle K. Lee
*Director of the United States Patent and Trademark Office*